US009524641B2

(12) United States Patent
Nguyen et al.

(10) Patent No.: US 9,524,641 B2
(45) Date of Patent: Dec. 20, 2016

(54) LED TRAFFIC SIGNAL FAULT LOGGING SYSTEM AND METHOD

(75) Inventors: Truong-Khoa Nguyen, Saint-Laurent (CA); Benoit Essiambre, Boisbriand (CA); Christian Poirier, Montreal (CA); Morné Neser, Montreal (CA)

(73) Assignee: GE LIGHTING SOLUTIONS, LLC, Cleveland, OH (US)

( * ) Notice: Subject to any disclaimer, the term of this patent is extended or adjusted under 35 U.S.C. 154(b) by 1203 days.

(21) Appl. No.: 13/053,735

(22) Filed: Mar. 22, 2011

(65) Prior Publication Data

US 2012/0242507 A1 Sep. 27, 2012

(51) Int. Cl.

| | |
|---|---|
| ***G08G 1/07*** | (2006.01) |
| ***G08G 1/095*** | (2006.01) |
| ***H05B 33/08*** | (2006.01) |
| ***H05B 37/03*** | (2006.01) |

(52) U.S. Cl.

CPC ..... *G08G 1/095* (2013.01); *H05B 33/0893* (2013.01); *H05B 37/03* (2013.01)

(58) Field of Classification Search

CPC ..... G08G 1/07; G08G 1/095; H05B 37/03; H05B 37/04; H05B 37/038; H05B 33/0893

USPC ..... 340/815.45, 907, 931, 458, 332, 815.4; 315/119, 129, 160, 291; 362/478, 800

See application file for complete search history.

(56) References Cited

U.S. PATENT DOCUMENTS

| | | | | |
|---|---|---|---|---|
| 4,376,910 | A | 3/1983 | Peslier | |
| 5,327,123 | A | 7/1994 | Heimann et al. | |
| 5,986,576 | A * | 11/1999 | Armstrong | 340/908 |
| 6,150,771 | A * | 11/2000 | Perry | 315/291 |
| 6,243,644 | B1 | 6/2001 | Dengler | |
| 6,369,704 | B2 | 4/2002 | Hilleary | |
| 6,667,623 | B2 * | 12/2003 | Bourgault et al. | 324/414 |
| 7,130,907 | B2 | 10/2006 | Aitken et al. | |
| 7,206,676 | B2 | 4/2007 | Cross et al. | |
| 7,215,970 | B2 | 5/2007 | Corrigan et al. | |
| 8,237,590 | B2 * | 8/2012 | Mihai et al. | 340/931 |
| 8,294,371 | B2 * | 10/2012 | Ghanem et al. | 315/119 |
| 2002/0000911 | A1 | 1/2002 | Hilleary | |
| 2003/0015973 | A1 | 1/2003 | Ovens et al. | |
| 2003/0187853 | A1 | 10/2003 | Hensley et al. | |
| 2005/0122229 | A1 * | 6/2005 | Stevenson et al. | 340/815.45 |

(Continued)

FOREIGN PATENT DOCUMENTS

| | | |
|---|---|---|
| CN | 101896951 A | 11/2010 |
| CN | 201662613 U | 12/2010 |

(Continued)

OTHER PUBLICATIONS

PCT Invitation to Pay Additional Fees dated Jul. 3, 2012 from corresponding Application No. PCT/US2012/029597.

(Continued)

*Primary Examiner* — Hung T Nguyen
(74) *Attorney, Agent, or Firm* — Fay Sharpe LLP

(57) ABSTRACT

Systems and methods for monitoring operating parameters of traffic lamps. A traffic lamp includes one or more memory modules and a controller. The controller receives data pertaining to one or more operating parameters of the traffic lamp and logs the one or more operating parameters to the one or more memory modules using the received data. The controller may log the one or more operating parameters to the one or more memory modules upon detection of a fault in the one or more operating parameters.

17 Claims, 3 Drawing Sheets

(56) References Cited

U.S. PATENT DOCUMENTS

| | | | |
|---|---|---|---|
| 2005/0206529 | A1 | 9/2005 | St.-Germain |
| 2006/0037075 | A1 | 2/2006 | Frattura et al. |
| 2008/0088478 | A1 | 4/2008 | Shillman et al. |
| 2008/0257047 | A1 | 10/2008 | Pelecanos et al. |

FOREIGN PATENT DOCUMENTS

| | | | |
|---|---|---|---|
| DE | 102009017989 | A1 | 10/2010 |
| EP | 0268060 | B1 | 5/1988 |
| EP | 0453643 | B1 | 10/1991 |
| EP | 0565992 | B1 | 10/1993 |
| EP | 0584895 | B1 | 3/1994 |
| EP | 0952757 | A2 | 10/1999 |
| EP | 1240790 | B1 | 9/2002 |
| EP | 1546464 | B1 | 6/2005 |
| WO | 2009070828 | A1 | 6/2009 |

OTHER PUBLICATIONS

Dai, Hui et al.: "ELF: An efficient log-structured flash file system for micro sensor nodes", Proceedings of the International Conference on Embedded Networked Sensor Systems, X, XX, Nov. 3, 2004, pp. 176-187.

PCT Search Report and Written Opinion dated Sep. 6, 2012 from corresponding Application No. PCT/US2012/029597.

Unofficial English translation of Office Action issued in connection with corresponding CN Application No. 201280014010.X on Nov. 3, 2014.

* cited by examiner

LED TRAFFIC SIGNAL FAULT LOGGING SYSTEM AND METHOD

BACKGROUND

The present exemplary embodiments relate generally to lighting. They find particular application in conjunction with traffic lamps, and will be described with particular reference thereto. However, it is to be appreciated that the present exemplary embodiments are also amenable to other like applications.

Traffic signals are typically disposed along roads to control the flow of traffic and/or make intersections more visible. Traffic signals may also be employed to provide warning to motorists, such as at railroad crossings. Traffic signals may include one or more traffic lamps, each having one or more light sources, such as LEDs, disposed therein. Typical colors used in traffic lamps include red, yellow and green.

One problem with traditional LED traffic lamps is that they can be difficult to repair when they fail. Namely, traditional LED traffic lamps are generally stateless, whereby log information is generally unavailable. As a result of this, when a traffic lamp fails, there is generally little information to aid one in tracking down the problem for purposes of repairing the traffic lamp. In the worst case scenario, one may need to check all the components of the traffic lamp.

Another problem with traditional traffic lamps is that their root cause of failure can be difficult to diagnosis. Namely, as noted above, traffic lamps are generally stateless. Therefore, when a traffic lamp fails, there is generally little information to aid one in tracking down the cause of the problem. This is especially true for causes that are highly variable, such as temperature.

The present disclosure contemplates new and improved systems and/or methods for remedying this and other problems.

BRIEF DESCRIPTION

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

According to aspects of the present disclosure, a traffic lamp for monitoring operating parameters thereof is provided. The traffic lamp includes one or more light sources, one or more memory modules, a power supplies, one or more sensors, and a controller. The controller receives data pertaining to one or more operating parameters of the traffic lamp and logs the one or more operating parameters to the one or more memory modules using the received data if the one or more operating parameters are not within acceptable limits.

According to another aspect of the present disclosure, a method for monitoring operating parameters of traffic lamps is provided. Data pertaining to one or more operating parameters of a traffic lamp is received. A determination is made as to whether the one or more operating parameters are within acceptable limits. The one or more operating parameters are then logged to one or more memory modules of the traffic lamp if the one or more operating parameters are not within acceptable limits.

According to another aspect of the present disclosure, a method of monitoring operating parameters of a traffic lamp performed by one or more processors is provided. Data pertaining to one or more operating parameters of a traffic lamp is received. A determination is made as to whether the one or more operating parameters are within acceptable limits. The one or more operating parameters are then logged to one or more memory modules of the traffic lamp at a regular interval. The traffic lamp is disabled if the one or more operating parameters are not within acceptable limits.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
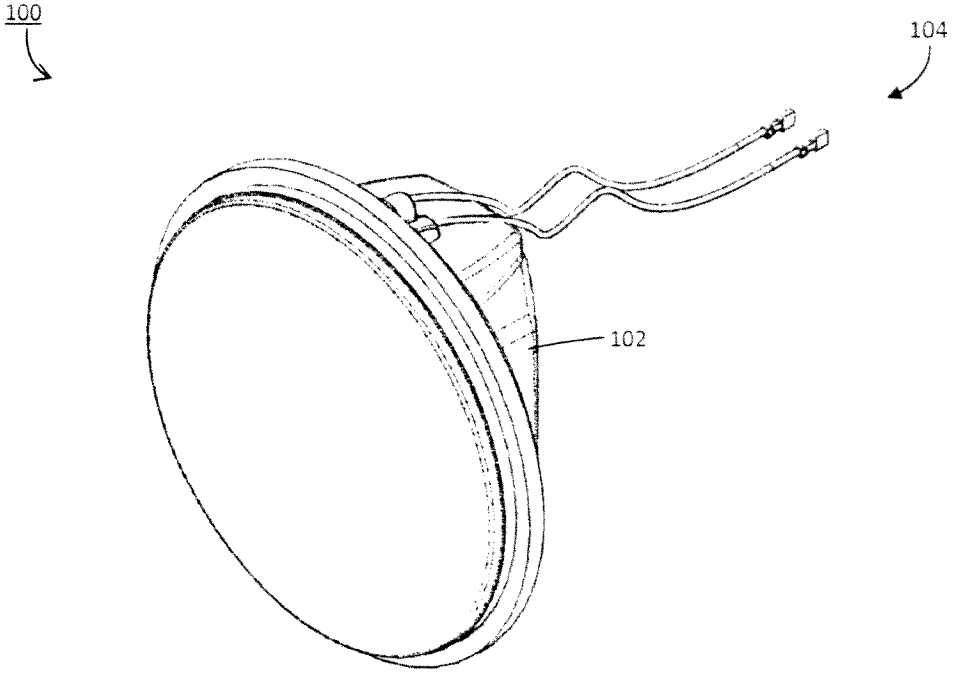
FIG. 1 is a perspective view of a traffic lamp according to aspects of the present disclosure.

One or more embodiments or implementations are hereinafter described in conjunction with the drawings, where like reference numerals are used to refer to like elements throughout, and where the various features are not necessarily drawn to scale.

With reference to FIG. 1, an illustrative embodiment of a traffic lamp 100 according to aspects of the present disclosure is provided. The illustrated traffic lamp 100 is typical of what one would find overhanging an intersection. Other embodiments of the traffic lamp 100 are, however, contemplated. The traffic lamp 100 includes a housing 102 and one or more connectors 104. The connectors 104 are provisioned to receive electrical power and, in certain embodiments, control commands from an external source (not shown), such as a traffic controller. Disposed within the housing 102, the traffic lamp 100 includes traffic lamp electronics 106, shown in FIG. 2, for monitoring operating parameters the traffic lamp 100.

Figure 2:
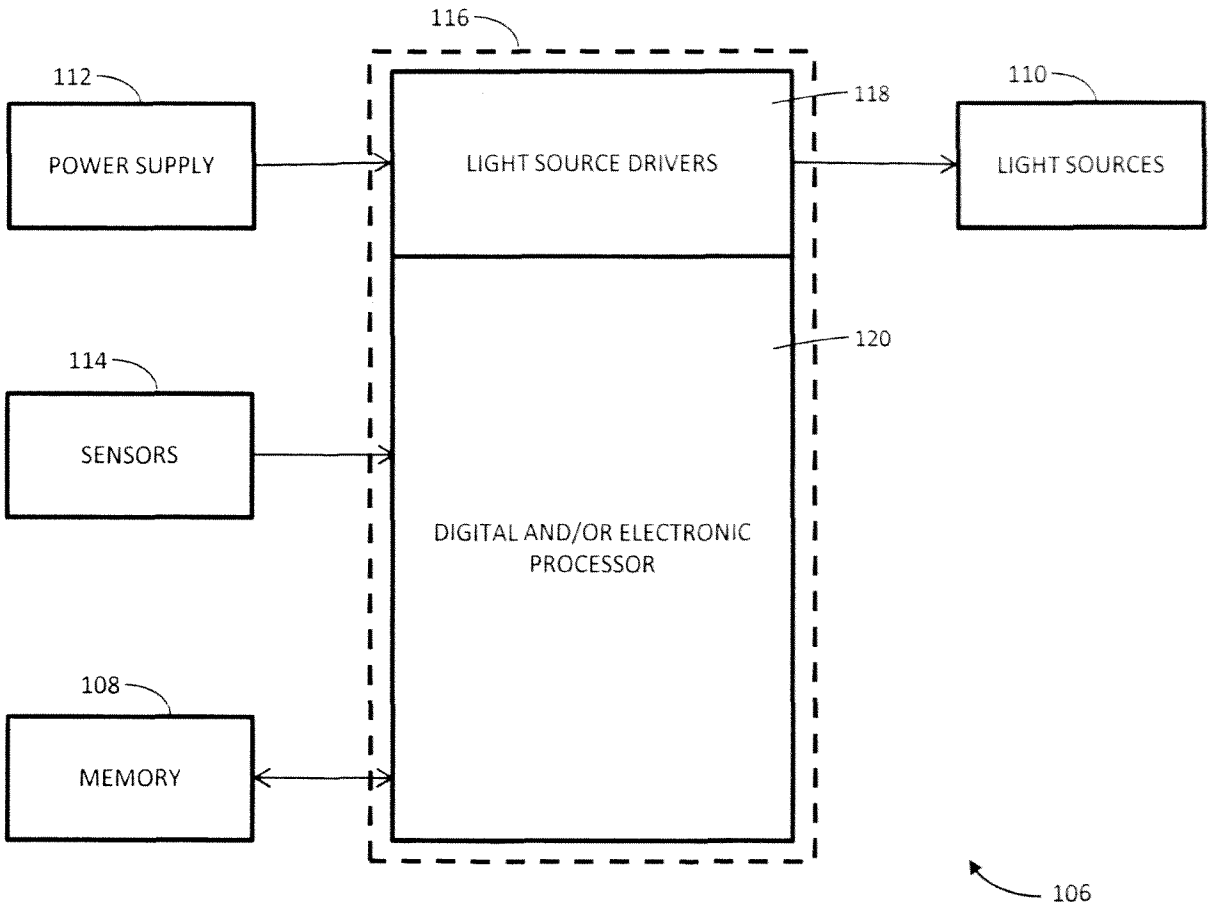
FIG. 2 is a block diagram of traffic lamp electronics for monitoring operating parameters of a traffic lamp according to aspects of the present disclosure; and, FIG. 3 is a block diagram of a method for monitoring operating parameters of a traffic lamp according to aspects of the present disclosure.

With reference to FIG. 2, a block diagram of the traffic lamp electronics 106 is provided. The traffic lamp electronics 106 include one or more memory modules (or memory) 108, one or more light sources 110, a power supply 112, one or more sensors 114, a controller 116, and the like. However, more or less components are equally amenable.

The memory 108 stores personality parameters for the traffic lamp 100. Personality parameters define the operating characteristics of the traffic lamp 100, such as output current to the light sources 110, and/or enable and/or disable features of the traffic lamp 100. Additionally or alternatively, the memory 108 stores log data associated with one or more operating parameters. Operating parameters correspond to operating conditions of the traffic lamp 100, such as operating time or input voltage. The memory 108 suitably includes one or more of a magnetic disk or other magnetic storage medium; an optical disk or other optical storage medium; read-only memory (ROM), Electrically Erasable Programmable Read-Only Memory (EEPROM), or other electronic memory device or chip or set of operatively interconnected chips; and the like. Further, the memory 108 suitably stores the log data and/or the personality parameters such that they persist on the memory 108 notwithstanding that power may be unavailable.

The light sources 110 generate light for the traffic lamp 100. Typically, the light sources 110 include one or more LEDs. However, it is contemplated that the light sources 110 may include one or more fluorescent tubes, halogen bulbs, and the like. Suitably, the colors of the light sources 110 are one or more of yellow, green and red. In certain embodiments, the light sources 110 are selected to control Correlated Color Temperature (CCT), Color Rendering Index (CRI), and other like characteristics of light.

The power supply 112 receives power from the external source and distributes said power to the constituent components of the traffic lamp electronics 106. The input voltage to the power supply 112 is typically an alternating current (AC) voltage, but it is contemplated that the received input voltage may be a direct current (DC) voltage. Further, the input voltage typically ranges from 0V to 265V and/or the input frequency typically ranges from 0 Hz to 150 Hz. Insofar as the received input voltage is AC, the power supply 112 converts it to DC. Although it is not shown, it is to be understood that the power supply 112 suitably includes one or more hardware components for distribution of the power to the traffic lamp electronics 106. These components may include, but are not limited to, one or more of a rectifier, surge protection circuit, electromagnetic interference filter circuit, one or more switching power supplies, a conflict monitor, one or more input fuses, a fuse blowout (FBO) circuit, a power factor correction power supply, software components, and the like.

The sensors 114 measure one or more operating parameters, such as input voltage, input frequency, light source current, and the like, of the traffic lamp 100. However, suitably the sensors 114 measure at least the operating (i.e., internal) temperature of the traffic lamp 100. In certain embodiments, the sensors 114 include one or more of passive and/or active electronic circuits, thermistors, temperature sensors, and the like.

The controller 116 controls the traffic lamp electronics 106 according to the personality parameters stored on the memory 108. As noted above, personality parameters define the operating characteristics of the traffic lamp 100 and/or enable and/or disable features of the traffic lamp 100. For example, the controller 116 may dim the light sources 110 according to a dimming personality parameter on the memory 108. Further, in certain embodiments, personality parameters may enable and/or disable features of the traffic lamp 100.

Additionally or alternatively, the controller 116 instructs one or more light source drivers 118 thereof as to the output current to provide to the light sources 110, so as to account for degradation factors and/or respond to traffic controller dimming requirement. The light source drivers 118 typically convert the voltage received from the power supply 112 to a compatible level for the light source and feed a DC current to the light source. The degradation factors are used for compensation of the light output of the light sources 110 and may include one or more of operating time of the light sources 110, temperature inside the traffic lamp 102, traffic controller dimming (set by the input voltage), and the like. As to traffic controller dimming, the light output of the light sources 110 may vary with the input voltage.

The instructions provided by the controller 116 suitably instruct the light source drivers 118 to use a calculated output current $I_{out}$ for the light sources 110, which may be defined as:

$$I_{out}=I_{nom}*f_{TH}*f_{De}*f_{Di}. \quad (1)$$

$I_{nom}$ is the nominal output current to the light sources 110 and may be a personality parameter. $f_{TH}$ is a temperature factor adjusting for temperature inside the traffic lamp 100. The light output of LEDs, for example, degrades with increased temperature. $f_{De}$ is a degradation factor adjusting for the age of the light sources 110, which is determined from log data on the memory 108. $f_{Di}$ is a dimming factor adjusting for changes in the input voltage of the traffic lamp 100.

Additionally or alternatively, the controller 116 monitors and/or logs operating parameters of the traffic lamp 100. Operating parameters correspond to operating conditions of the traffic lamp 100 and may pertain to software and/or hardware functionality. As will be seen, monitoring and logging operating parameters of the traffic lamp 100 may allow quick diagnosis of failures of the traffic lamp 100.

Typically, operating parameters include one or more of: current personality parameters; a calculated output current to the light sources 110; a measured output current to the light sources 110; an input voltage to the traffic lamp electronics 106 (i.e., the input voltage the power supply 112 receives from the external source); an input frequency to the traffic lamp electronics 106 (i.e., the frequency the power supply 112 receives from the external source); the operating time of the traffic lamp 100; the temperature of the traffic lamp 100; one or more failure detection features of the traffic lamp electronics 106; and the like.

The current personality parameters suitably correspond to the personality parameters currently used by the traffic lamp electronics 106. As noted above, personality parameters define the operating characteristics of the traffic lamp 100 and/or enable and/or disable features of the traffic lamp 100. For example, personality parameters may control the nominal output current provided to the light sources 110.

The operating time of the traffic lamp 100 suitably corresponds to the amount of time the light sources 110 and/or the traffic lamp electronics 106 have been in operation. In certain embodiments, the operating time of the light sources 110 and/or the traffic lamp electronics 106 includes one or more of the number of hours, the number of minutes, the number of seconds, the number of hundredths of a second, and the like.

The input voltage, in addition to being important to the calculated output current, is also important for determining whether the traffic lamp 100 should be ON or OFF. Namely, the input voltage of the traffic lamp 100 will generally be variable, whereby the traffic lamp 100 generally needs to be capable of working across a wide range of input voltages. For example, in North America, the traffic lamp 100 must generally be ON from 80V to 135V; below 35V the traffic lamp 100 must generally be OFF; and from 35V to 80V the traffic lamp 100 can generally be ON or OFF. As another example, in Europe, the traffic lamp 100 must generally be ON from 120V to 265V; below 80V the traffic lamp 100 must generally be OFF; and from 80V to 120V the traffic lamp 100 can generally be ON or OFF.

The failure detection features may be set if abnormal operating parameters are detected. For example, a failure detection feature may be set if the input voltage of the traffic lamp 100 is over a predetermined threshold. As noted above, the controller 116 may monitor the operating parameters. Therefore, in certain embodiments, the controller 116 may set the failure detection features.

Monitoring operating parameters may entail receiving data pertaining to one or more operating parameters of the traffic lamp 100 from one or more hardware and/or software components comprising the traffic lamp 100. For example, data pertaining to the input voltage of the traffic lamp 100 may be received from the power supply 112 and processed by a software component of the controller 116. The received data may include the present values of operating parameters and/or data necessary to calculate the present values of operating parameters.

Monitoring may further include calculating values for one or more operating parameters (e.g., the calculated output current) from the received data and/or determining whether the operating parameters are within acceptable limits based on this received data. As to the determination, values for operating parameters (whether calculated or directly measured) may be compared against expected values for the operating parameters. If an operating parameter falls outside acceptable limits a fault is detected.

Logging operating parameters of the traffic lamp 100 suitably entails writing values (calculated or otherwise) of one or more of the operating parameters to the memory 108. In certain embodiments, the values of operating parameters may overwrite previously written log data. For example, logging may entail maintaining extremes for different operating parameters, such as the maximum and/or minimum input voltages encountered. As another example, logging may entail maintaining the current values of operating parameters. In other embodiments, the values of operating parameters may be written as a log entry indexed by time, where each log entry includes one or more operating parameters.

Suitably, logging is performed when one or more of the operating parameters are determined to fall outside acceptable limits (i.e., a fault is detected). However, other triggers for logging are equally amenable. For example, logging may be performed at periodic intervals as determined by, for example, a timer of the controller 116. As another example, logging may be performed right before the traffic lamp goes in to an OFF state.

In certain embodiments, a cyclical buffer scheme may be used for data logging. This may help conserve the physical integrity of the memory 108 by reducing the number of write cycles to a specific memory location. Further, cyclical buffering alleviates problems involved with using a finite amount of memory.

The cyclical buffer scheme may divide at least a portion of the memory 108 into equally sized units, called pages. Each page may correspond to a different memory location. Log data may then be written to one of the pages up to a predetermined number of times. After log data is written to this page the predetermined number of times, log data may then be written to a different one of the pages up to the predetermined number of times and so on. When all the pages have been written to the same number of times, the process repeats with each page treated as having been unused.

Additionally or alternatively, the controller 116 disable the traffic lamp 100 if a fault is detected while monitoring the operating parameters. Disabling the traffic lamp 100 may advance interests of safety. In certain embodiments, the controller 116 may disable the traffic lamp 100 by blowing a fuse of the power supply 112. The fuse may be blown using a fuse blowout circuit. In certain embodiments, after the fuse is blown, an associated traffic controller (not shown) detects that the traffic lamp 100 is no longer functioning so it can take appropriate actions.

To carry out the above-noted functionality, the controller 116 generally includes a digital/electronic processor 120, such as a microprocessor, microcontroller, graphic processing unit (GPU), and the like. In such embodiments, the controller 116 suitably executes instructions embodying the above-noted functions using the processor 120, Suitably, the instructions are stored on the memory 108 of the traffic lamp 100. However, it is contemplated that the instructions are stored local to the processor 120 and one of ROM, EPROM, EEPROM, Flash memory, and the like. The controller 116 suitably communicates with the memory 108 via a communications protocol, such as I2C, 1 Wire, SPI, and the like. The communications protocol may be carried over one or more of a data bus, a communications network, and the like.

Figure 3:
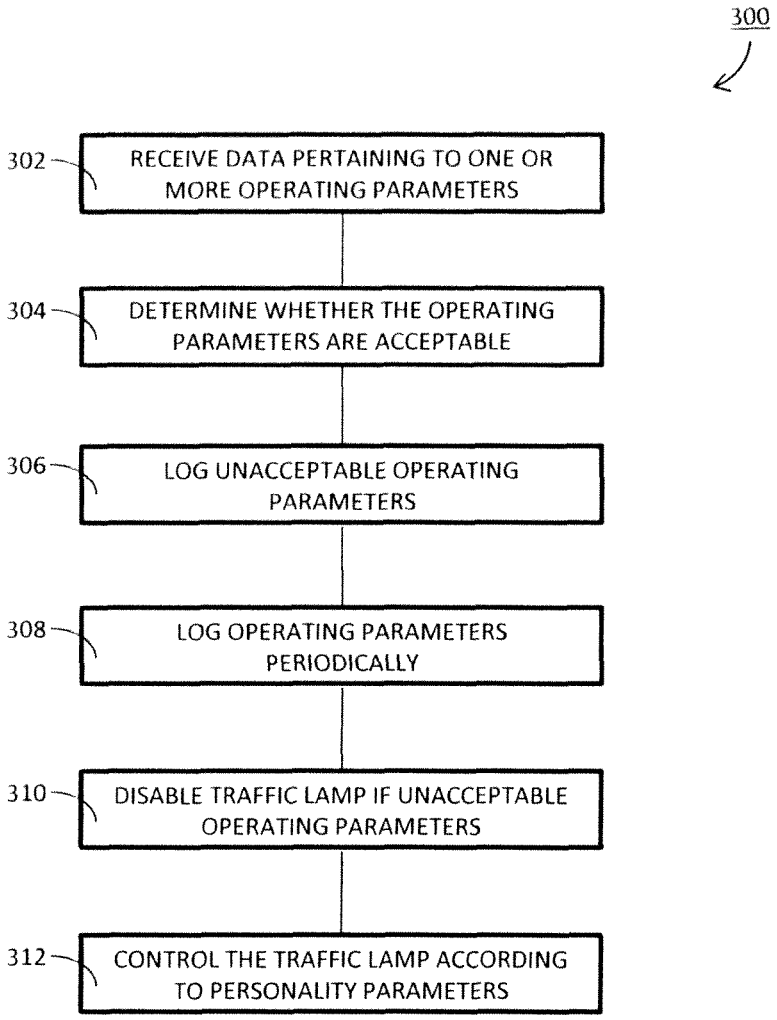

With reference to FIG. 3, a block diagram of a method 300 for monitoring operating parameters of a traffic lamp is illustrated. The controller 116 of FIG. 2 suitably performs the method 300. However, it is contemplated that the method 300 may be performed with other components of the traffic lamp.

Data pertaining to one or more operating parameters of a traffic lamp are received 302. For example, the data are received from the sensors 114. The one or more operating parameters include one or more of light source current, light source voltage, input voltage, input frequency, total input power, power supply voltages, operating temperature, operating life, and options boards conditions. It is contemplated that the data are received continuously or up to the occurrence of an event, such as a timer event. In certain embodiments, where the data are received continuously it is broken into discrete blocks based on time and a trending algorithm, such as minimum, maximum, median, mean, and so on, is applied to each block.

After the receipt of the data, a determination 304 as to whether the one or more operating parameters are within acceptable limits is made. Suitably, this is performed through comparison of operating parameter values to known limits, optionally stored on, for example, the memory 108.

If the one or more operating parameters are not within acceptable limits, at least one of the one or more operating parameters is logged 306 to a memory, such as the memory 108. In certain embodiments, at least one of the one or more operating parameters is further logged 308 to the memory of the traffic lamp at a regular interval. Regardless of the reason for logging, the logging may use a cyclical buffering scheme. The cyclical buffering scheme includes dividing the memory into one or more pages. Further, the cyclical buffer scheme includes writing log data to one of the one or more pages up to a predetermined number of times and then moving to a different one of the one or more pages.

In certain embodiments, the method 300 further includes disabling 310 the traffic lamp if the one or more operating parameters are not within acceptable limits. Disabling can include blowing a fuse. Additionally or alternatively, in certain embodiments, the method 300 includes controlling 312 the traffic lamp according to the one or more personality parameters and/or calculating present values of at least one of the one or more operating parameters.

The disclosure has been made with reference to preferred embodiments. Obviously, modifications and alterations will occur to others upon reading and understanding the preceding detailed description. It is intended that the preferred embodiments be construed as including all such modifications and alterations insofar as they come within the scope of the appended claims or the equivalents thereof.

The invention claimed is:

1. A traffic lamp comprising:

one or more light sources;

one or more memory modules;

one or more sensors; and a controller that:

receives data pertaining to one or more operating parameters of the traffic lamp, wherein the received data including data from the sensors;

logs at least one of the one or more operating parameters to the one or more memory modules using the received data if the one or more operating parameters are not within acceptable limits;

further logs the at least one of the one or more operating parameters to the one or more memory modules of the traffic lamp at a regular interval; and disables the traffic lamp if the one or more operating parameters are not within acceptable limits.

2. The traffic lamp of claim 1, wherein the memory includes one or more personality parameters, wherein the controller controls the traffic lamp according to the one or more personality parameters.

3. The traffic lamp of claim 2, wherein the controller controls the light sources according to at least one of the one or more personality parameters.

4. The traffic lamp of claim 1, wherein the controller calculates present values of at least one of the one or more operating parameters.

5. The traffic lamp of claim 1, wherein the one or more operating parameters include one or more of light source current, light source voltage, input voltage, input frequency, total input power, power supply voltages, operating temperature, operating life, and options boards condition.

6. The traffic lamp of claim 1, wherein the controller monitors the operating parameters of the traffic lamp for faults and disables the traffic lamp if a fault is detected.

7. The traffic lamp of claim 6, where said traffic lamp further comprises:

a fuse, wherein said controller disables the traffic lamp by blowing the fuse.

8. The traffic lamp of claim 1, wherein the controller logs at least one of the one or more parameters to the one or more memory modules using a cyclical buffering scheme.

9. The traffic lamp of claim 8, wherein the cyclical buffering scheme includes:

dividing data in the one or memory modules into one or more pages; and, writing log data to one of the one or more pages up to a predetermined number of times and then moving to a different one of the one or more pages.

10. A method of monitoring operating parameters of traffic lamps performed by one or more processors, said method comprising:

receiving data pertaining to one or more operating parameters of a traffic lamp;

determining whether the one or more operating parameters are within acceptable limits;

logging at least one of the one or more operating parameters to one or more memory modules of the traffic lamp if the one or more operating parameters are not within acceptable limits;

further logging the at least one of the one or more operating parameters to the one or more memory modules of the traffic lamp at a regular interval; and disabling the traffic lamp if the one or more operating parameters are not within acceptable limits.

11. The method according to claim 10, where the disabling includes blowing a fuse.

12. The method of claim 10, wherein the logging uses a cyclical buffering scheme.

13. The method of claim 12, wherein the cyclical buffering scheme includes:

dividing data in the one or more memory modules into one or more pages; and, writing log data to one of the one or more pages up to a predetermined number of times and then moving to a different one of the one or more pages.

14. The method of claim 10, wherein the one or more operating parameters include one or more of light source current, light source voltage, input voltage, input frequency, total input power, power supply voltages, operating temperature, operating life, and options boards condition.

15. The method of claim 10, further comprising:

controlling the traffic lamp according to the one or more personality parameters.

16. The method of claim 10, further comprising:

calculating present values of at least one of the one or more operating parameters.

17. A method of monitoring operating parameters of a traffic lamp performed by one or more processors, said method comprising:

receiving data pertaining to one or more operating parameters of a traffic lamp;

determining whether the one or more operating parameters are within acceptable limits;

logging at least one of the one or more operating parameters to one or more memory modules of the traffic lamp if the one or more operating parameters are not within acceptable limits;

further logging the at least one of the one or more operating parameters to the one or more memory modules of the traffic lamp at a regular interval; and disabling the traffic lamp if the one or more operating parameters are not within acceptable limits.

* * * * *